US005433264A

United States Patent [19]

Dorigo et al.

[11] Patent Number: 5,433,264

[45] Date of Patent: Jul. 18, 1995

[54] ASSEMBLY TO WIND-UNWIND THIN SLABS

[75] Inventors: Alessandro Dorigo; Bruno Di Giusto, both of Udine, Italy

[73] Assignee: Danieli & C. Officine Meccaniche SpA., Buttrio, Italy

[21] Appl. No.: 78,853

[22] Filed: Jun. 21, 1993

[30] Foreign Application Priority Data

Jun. 30, 1992 [IT] Italy ..... UD92A0118

[51] Int. Cl.[6] ..... B21B 1/46; B22D 11/12; B22D 11/20

[52] U.S. Cl. ..... 164/417; 29/33 C; 72/200

[58] Field of Search ..... 164/417, 477; 29/33 C, 29/527.7; 72/200

[56] References Cited

U.S. PATENT DOCUMENTS

| | | | |
|---|---|---|---|
| 4,675,974 | 6/1987 | Connolly | 72/200 X |
| 4,958,677 | 9/1990 | Kimura | 164/417 X |
| 4,976,024 | 12/1990 | Kimura | 164/417 X |

FOREIGN PATENT DOCUMENTS

| | | | |
|---|---|---|---|
| 0321733 | 11/1988 | European Pat. Off. . | |
| 735568 | 11/1932 | France . | |
| 1308895 | 10/1962 | France . | |
| 1462911 | 12/1966 | France . | |
| 972603 | 9/1959 | Germany . | |
| 2613459 | 10/1977 | Germany . | |
| 282185 | 9/1990 | Germany | 29/33 C |
| 59-153555 | 9/1984 | Japan | 164/417 |
| 2-133150 | 5/1990 | Japan | 164/417 |
| WO89/08512 | 9/1989 | WIPO . | |

OTHER PUBLICATIONS

Patent Abstracts of Japan vol. 13, No. 107 (C-576) (3455) Mar. 14, 1989 & JP-A-63-282215 (Hitachi, Ltd.) 18 Nov. 1988 Abstract.

Iron and Steel Engineer, vol. 69, No. 2, Feb. 1992, PA, USA pp. D25-D27, XP000254016 Labee et al "Development in the iron and steel industry US and Canada 1991", p. 26 Left column line 6-right column line 8; FIG.

*Primary Examiner*—J. Reed Batten, Jr.

*Attorney, Agent, or Firm*—Antonelli, Terry, Stout & Kraus

[57] ABSTRACT

Assembly to wind-unwind thin slabs which cooperates with a continuous casting plant (11) producing thin slabs (12) and is positioned on the same axis as that plant (11), a heating and temperature-equalization furnace (17) being included upstream of the winding-unwinding assembly (10), at least one pair of drawing rolls (23) cooperating with the winding-unwinding assembly (10), which comprises two coiling-uncoiling units (**20*a*–20*b*) positioned circumferentially equidistant from, and on, a base plate (21) able to rotate about a substantially central vertical axis, one of the units (20*a*–20*b*) taking over alternately the position and function of the other unit (20*a*–20*b*) and viceversa, each coiling-uncoiling unit (20*a*–20*b*) being equipped with its own lead-in guide (26) and powered rolls (28), the powered rolls (28) being coplanar and positioned below the thin slab (12) and cooperating with a curvature-imparting roll (29), which can be moved from a position of cooperation with, and between the powered rolls (28) to an upper position when a coiled roll (33) has been fully coiled, the curvature-imparting roll (29) cooperating with an actuator (32) that adjust its pressure towards the powered rolls (28), the actuator (32) being associated with an arm (30) that supports the curvature-imparting roll (29), the lead-in guide (26) lying on the same plane as the plane of feed of the thin slab (12) and as the upper side of the powered rolls (28**).

19 Claims, 3 Drawing Sheets

11
12
13
14a
14b
14c
15
16
17
18
19
20a
20b
23
39c
43
49
10
45
46a
46b
47
48
115
215
12b

ASSEMBLY TO WIND-UNWIND THIN SLABS

BACKGROUND OF THE INVENTION

The invention concerns an assembly to wind-unwind thin slabs.

The winding-unwinding assembly according to the invention is installed advantageously downstream of continuous casting plants producing thin slabs or downstream of roughing rolling mill stands.

This winding-unwinding assembly is employed to wind thin slabs leaving a continuous casting plant, or leaving the temperature-equalisation furnace downstream of continuous casting plants producing thin slabs, or leaving a roughing rolling mill stand and has the task of forming coiled rolls of slab which are uncoiled thereafter for use in the successive rolling operations.

U.S. Pat. No. 4,630,352 discloses a winding-unwinding assembly in which the thin slab leaving a continuous casting plant is caused to cooperate with a temperature-equalisation furnace before cooperating with the winding-unwinding assembly.

This winding-unwinding assembly comprises two substantially horizontal winding-unwinding drums, the axes of rotation of which are arranged on a substantially vertical plane perpendicular to the direction of feed of the thin slab.

These two drums are positioned respectively above and below the plane of feed of the thin slab to be wound-unwound and cooperate advantageously with burners which keep the temperature of the slab at a pre-set value.

A movable guide table is fitted in the space between the respective upper and lower drums and is positioned substantially on the same plane as the plane of feed of the thin slab. This movable guide table directs the thin slab upwards or downwards as required for the winding of the thin slab on the upper or lower drum respectively.

At least one rolling mill stand is installed downstream of the winding-unwinding assembly.

In this way, while one thin slab is being coiled on one of the two winding-unwinding drums, the thin slab already coiled on the other winding-unwinding drum is unwound and caused to cooperate with the rolling mill stand and is then wound onto an auxiliary winding-unwinding drum positioned downstream of the rolling mill stand.

By making the thin slab pass through the rolling mill stand a desired number of times in both directions from the aforesaid other winding-unwinding drum to the auxiliary winding-unwinding drum and back again, it is possible to produce a coiled roll of sheet of the required thickness.

This embodiment requires that one of the two winding-unwinding drums should be positioned below the plane of the feed of the thin slab and thus entails considerable excavation and building operations.

EP-A-0321733 too discloses a winding-unwinding assembly in which two winding-unwinding units are positioned substantially vertically opposite each other; this lay-out entails very high costs for the excavation operations required.

GB-B-1,075,789 discloses a winding-unwinding assembly in which two winding-unwinding drums are arranged diametrically opposite to each other on a substantially horizontal rotary platform. Each winding-unwinding drum is fitted onto an underlying saddle, which can move vertically to suit the various dimensions of the coils being formed.

Furthermore, the winding-unwinding drums comprise a shaft which can be extended lengthwise and on which is installed a means to expel the coil, which is engaged by a loading arm positioned laterally on the same axis as one of the winding-unwinding drums; the winding assembly disclosed is somewhat complex.

The state of the art contains also cradle-type winding-unwinding assemblies, in which the coiled roll of thin slab is taken from its supporting cradle and is discharged onto an unwinding cradle. This embodiment requires means to handle the wound rolls and therefore becomes very complicated and necessitates a considerable financial investment.

WO-A-8908512 discloses a winding-unwinding assembly in which two winding-unwinding units are solidly fitted to a rotary platform and are contained within a chamber solidly installed above the rotary platform. The chamber includes two lateral openings arranged respectively opposite to each other along the axis of feed of the slab so as to enable the slab being wound to enter at one side and the slab being unwound to emerge at the other side.

These openings are very high so as to make possible the operations of winding and unwinding the slab and therefore lead to a great loss of heat from the slab, which has to be heated within the chamber so that its temperature can be kept at a pre-set value. Moreover, the chamber includes a stationary intermediate wall which separates the winding unit from the unwinding unit, thus making impossible the elimination of the operation of winding/unwinding the slab even when the rolling line downstream of the winding-unwinding assembly travels at the same speed as the continuous casting plant feeding the winding-unwinding assembly.

Moreover, in the winding-unwinding assembly disclosed the pairs of rolls drawing the slab entering or leaving the winding-unwinding assembly are positioned outside the chamber, with a resulting further loss of heat from the thin slab being processed.

The present applicants have designed, tested and embodied this invention to overcome the shortcomings of the state of the art, as requested by users for some time now, and to achieve further advantages.

SUMMARY OF THE INVENTION

A purpose of this invention is to provide an assembly for the winding-unwinding of thin slabs directly or downstream of an interposed machine; the assembly is associated with a continuous casting plant producing thin slabs and is able to cooperate with a rolling line positioned downstream, which may be of a continuous or not continuous type.

Moreover, the invention enables the winding-unwinding assembly to be shut down momentarily when winding operations are not necessary.

In fact, the thin slab can pass through the winding-unwinding assembly according to the invention without undergoing any coiling operation whenever the rolling line downstream of the winding-unwinding assembly is working continuously at the same speed as the continuous casting plant feeding the winding-unwinding assembly.

Another purpose of the invention is to provide a winding-unwinding assembly which is very compact and requires less building work for its installation and functioning, thus lessening the overall cost of the plant considerably.

Furthermore, the winding-unwinding assembly according to the invention can be fully insulated, thus reducing the loss of heat to a minimum.

The winding-unwinding assembly according to the invention is installed advantageously, but not necessarily, in a rolling line positioned downstream of a continuous casting plant.

To be more exact, the winding-unwinding assembly according to the invention is positioned advantageously upstream of the actual rolling line and downstream of an advantageously insulated roller conveyor, which is located advantageously downstream of a temperature-equalisation furnace.

The temperature-equalisation furnace may be located immediately downstream of a continuous casting plant or immediately downstream of a roughing rolling mill stand.

The winding-unwinding assembly according to the invention includes two symmetrical coiling-uncoiling units placed in sequence and in line with the direction of feed of the thin slab leaving the roller conveyor. These two coiling-uncoiling units are fitted to a base plate, which can be rotated by at least 180° about a substantially vertical axis placed in the middle between the two coiling-uncoiling units.

This rotary base plate is installed so as to be able to slide on a stationary circular guide and is driven by a suitable motor.

According to a variant the coiling-uncoiling units on the base plate are three or more in number, but advantageously four, and constitute a storage point in the event of jamming or other problems in the rolling line downstream.

A unit to drive the winding-unwinding assembly is installed in cooperation with the motor.

According to a variant the base plate can rotate by 360°.

According to another variant the base plate can rotate by 360° continuously.

If the drive unit and the assemblies producing power (oleodynamic, pneumatic, etc.) are included on the base plate, there remains only the problem of transferring the basic electrical energy from the exterior.

In the winding-unwinding assembly according to the invention the only means below the plane of feed of the slabs is the motor, and therefore the winding-unwinding assembly can be introduced into the plant without requiring great building works since the trench to be dug is of a small size; thus the cost of the plant is greatly restricted.

A removable insulated hood is associated, both at the sides and above, with each of the two coiling-uncoiling units so as to reduce the loss of heat to the environment to a minimum and to prevent the resulting cooling of the thin slab.

Owing to the structure itself of the invention the insulated hood is able to enclose the whole assembly fully and thoroughly.

To be more exact, the hood encloses an insulated chamber containing not only the rotary platform supporting the coiling-uncoiling units but also the upstream and downstream drawing assemblies so as to reduce the loss of heat to a minimum and to ensure a high and substantially constant temperature of the thin slab.

According to a variant, heating means to keep the coiled thin slab at the required temperature cooperate with the two coiling-uncoiling units and with the insulated hood.

The heating means may consist, for instance, of electrical resistors or of a series of small burners positioned on the walls containing and covering the winding-unwinding assembly according to the invention.

The two coiling-uncoiling units are separated advantageously by a stationary inner partition, which too is insulated advantageously and isolates one of the two coiling-uncoiling units, for instance when the other coiling-uncoiling unit has to undergo maintenance.

According to a variant the inner partition can be displaced and removed and is installed only when the working conditions require its presence.

Each of the coiling-uncoiling units cooperates at its inlet and outlet with respective pairs of opposed drawing rolls, at least one of which is powered.

The pairs of drawing rolls are fitted to a stationary base and do not form part of the rotatable winding-unwinding assembly according to the invention.

According to a variant the pairs of drawing rolls are fitted to the rotary base plate.

According to yet another variant the pairs of drawing rolls are installed within the insulated chamber defined by the insulated hood and insulated sidewalls.

The thin slabs being wound and unwound respectively cooperate with the drawing rolls.

The thin slabs being wound and unwound respectively cooperate with lead-in guides belonging to their own coiling-uncoiling unit.

The drawing rolls are equipped advantageously with means to adjust their speed of rotation so that they can draw the thin slab being wound or unwound at a linear speed of feed which is suitable for, and correlated with, the processing machines positioned upstream and downstream.

The drawing rolls, when performing the task of assisting the coiling, are associated with means which can raise quickly the linear speed of feed of the thin slab, as will be made clear hereinafter.

The thin slab leaving the lead-in guide cooperates with a device which imparts a curvature to the slab and which, by means of an operation imparting curvature, brings the thin slab being wound to roll itself about a curvature-imparting roll so as to form the required coil.

The device imparting curvature includes a pair of powered rotary rolls fitted so that they cannot be displaced and are positioned parallel to each other with their axes of rotation substantially horizontal and normal to the direction of feed of the thin slab.

The curvature-imparting roll cooperates with the pair of powered rolls and is positioned higher than, and in a position substantially parallel to, and between, the pair of powered rolls.

The ends of the curvature-imparting roll are fitted to the free ends of a pair of oscillatory arms, which are pivoted at their other ends and are actuated by a positioner means that keeps the curvature-imparting roll pressed downwards so as to exert the action of imparting curvature to the thin slab passing through.

At least one of the oscillatory arms can be released so as to leave the curvature-imparting roll supported as a cantilever, thus permitting access to the coil of the thin slab on the powered rolls and enabling that coil to be engaged with an appropriate hook if necessary.

An idler dancer roller is included downstream of, and parallel to, the second powered roll and is actuated by suitable positioner means consisting, for instance, of a hydraulic cylinder/piston actuator.

The dancer roller cooperates with the leading end of the thin slab at the beginning of the coiling of the slab.

The dancer roller has at least one position of non-contact taken up at least during the uncoiling of the coil and also a position of contact which can be varied to suit the outer diameter of the coil being formed.

The dancer roller in its position of contact has the task of cooperating with the leading end of the thin slab leaving the curvature-imparting device during the coiling operation and imparts to that leading end the first radius of curvature so as to form the beginning of the first coil of the thin slab.

At the end of the formation of the coiled roll on the first coiling-uncoiling unit the winding-unwinding assembly according to the invention is rotated by 180° about its substantially vertical axis of rotation.

This rotation brings the second coiling-uncoiling unit to the point of arrival of a thin slab, while the first coiling-uncoiling unit is brought to face the downstream rolling line.

An appropriate sensor authorises rotation of the winding-unwinding assembly as soon as the trailing end of a thin slab is on the lead-in guide.

A sensor is positioned at the inlet of the insulated roller conveyor located downstream of the temperature-equalisation furnace and upstream of the winding-unwinding assembly and detects the arrival of the tail end of the downstream thin slab and the arrival of the leading end of the next thin slab.

This sensor, when it has detected the arrival of the tail end of one thin slab being coiled, transmits a signal which causes acceleration of the winding drawing rolls and of the relative coiling-uncoiling unit performing the winding.

A separation is brought about in this way between the tail end of the preceding thin slab, which is caused to travel momentarily at a higher speed, and the leading end of the next thin slab, which still travels at its normal speed. This separation enables the winding-unwinding assembly according to the invention to coil the preceding thin slab fully on the first coiling-uncoiling unit and then to rotate by 180° about its axis of rotation and to have its second coiling-uncoiling unit ready to perform coiling when the leading end of the next thin slab arrives.

The curvature-imparting rolls and idler dancer rollers, if the winding step is omitted, are kept in their position of non-contact and the thin slab cooperates not only with the lead-in guides and powered rolls of the curvature-imparting devices but also with appropriate supporting means.

The supporting means are positioned substantially on the same plane as the rotary powered rolls of the curvature-imparting device and at an intermediate position between the two coiling-uncoiling units.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

In the attached figures the reference number 10 indicates generally a winding-unwinding assembly according to the invention.

Figures 1, 2A, 2B, 2C:
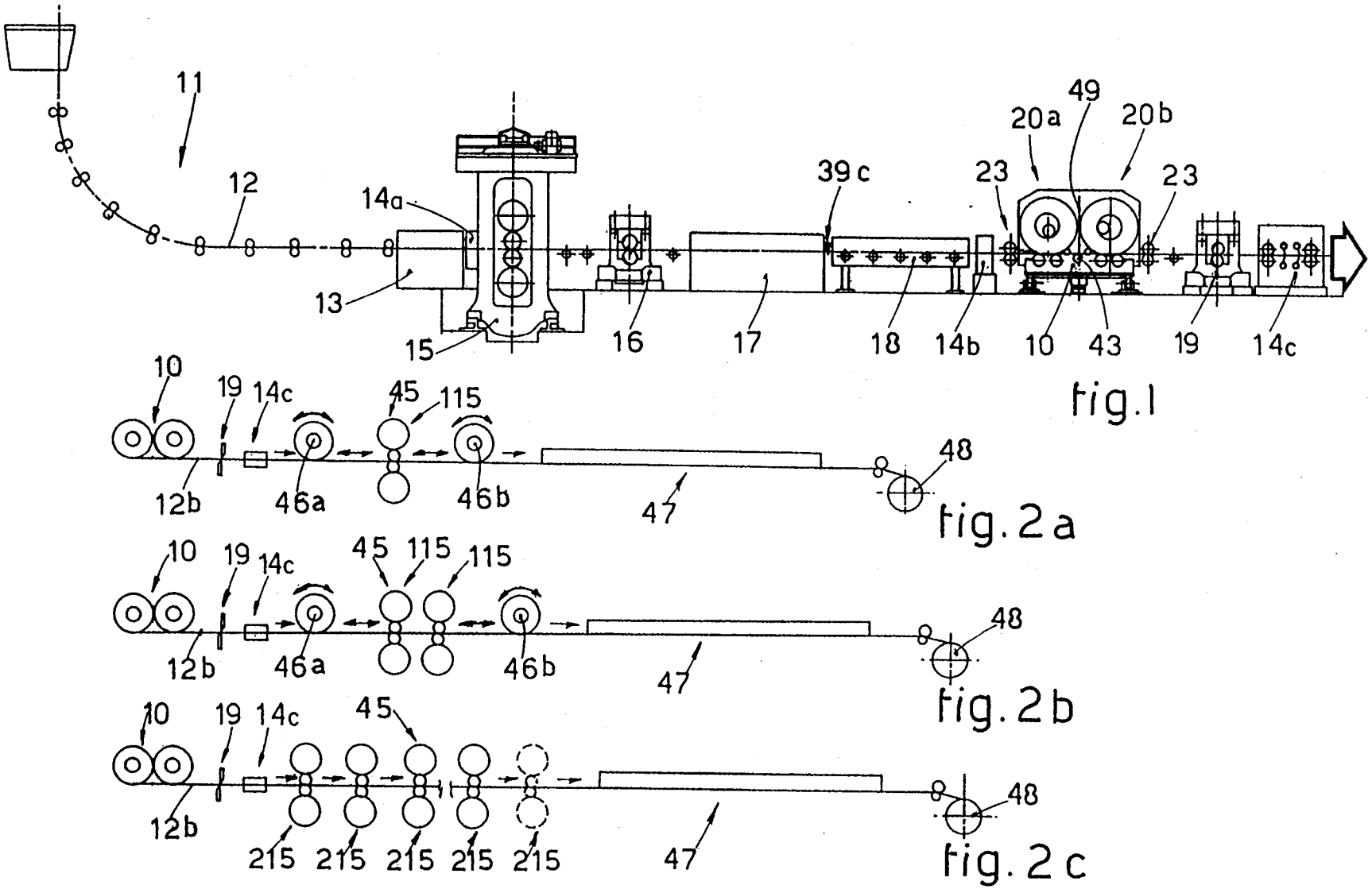
FIG. 1 is a diagram of a continuous casting plant feeding a rolling line in which is installed a winding-unwinding assembly according to the invention.
FIGS. 2*a*, 2*b* and 2*c* are diagrams of three possible rolling plants associated with a winding-unwinding assembly according to the invention.

FIG. 1 shows a plant in which the winding-unwinding assembly 10 according to the invention is installed downstream of a continuous casting machine 11 producing thin slabs 12.

The thin slab 12 leaving the continuous casting machine 11 is caused to cooperate with a heating and temperature-equalisation furnace 13 and thereafter with a first scale-removal means 14*a* followed by a roughing rolling mill stand 15 and a shears 16, which shears the thin slab 12 to the required length.

Next, the thin slab 12 cooperates with a temperature-equalisation furnace 17 followed by an advantageously insulated roller conveyor 18, at the outlet of which is installed the winding-unwinding assembly 10 according to the invention, possibly preceded by a second scale-removal means 14*b*.

A first sensor 39*c* is fitted at the inlet of the roller conveyor 18 and detects the arrival of the tail end of the preceding thin slab 12 and the leading end of the next thin slab 12; the purpose of this first sensor 39*c* will be made clear in the description that follows.

An emergency shears 19 and a scale-removal means 14*c* are positioned downstream of the winding-unwinding assembly 10 in this example.

In this case the winding-unwinding assembly 10 according to the invention comprises two coiling-uncoiling units 20, namely a first unit 20*a* and a second unit 20*b* respectively, positioned on and solidly fixed to a rotary base plate 21 driven by a motor 22.

Figure 4A:
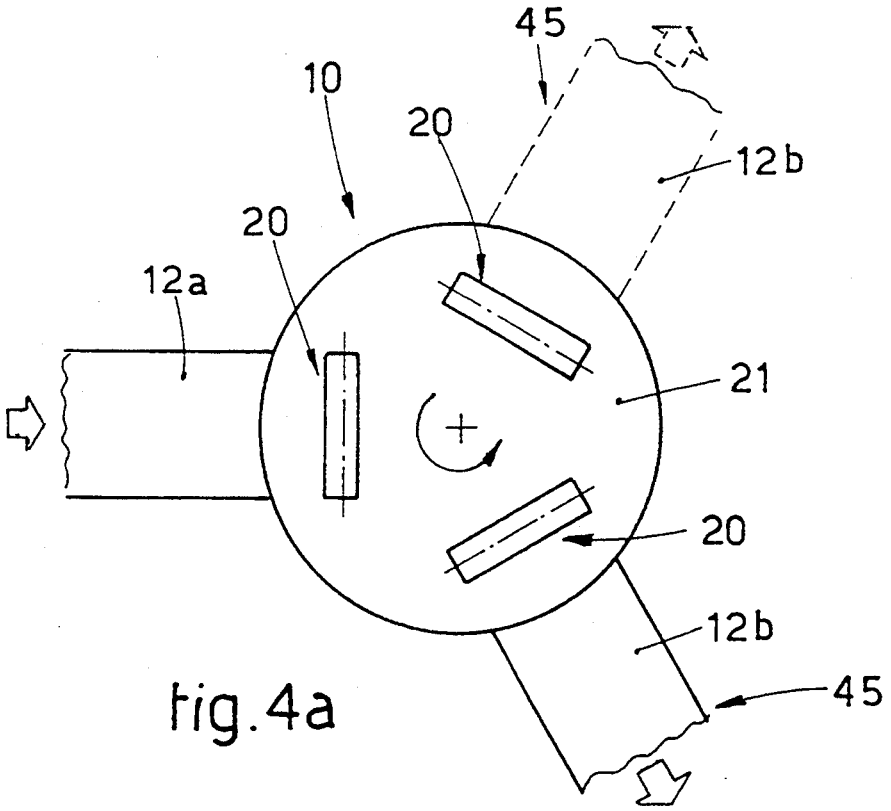
FIGS. 4*a* and 4*b* give plan views of two variants of the winding-unwinding assembly of FIG. 3.
Figure 4B:
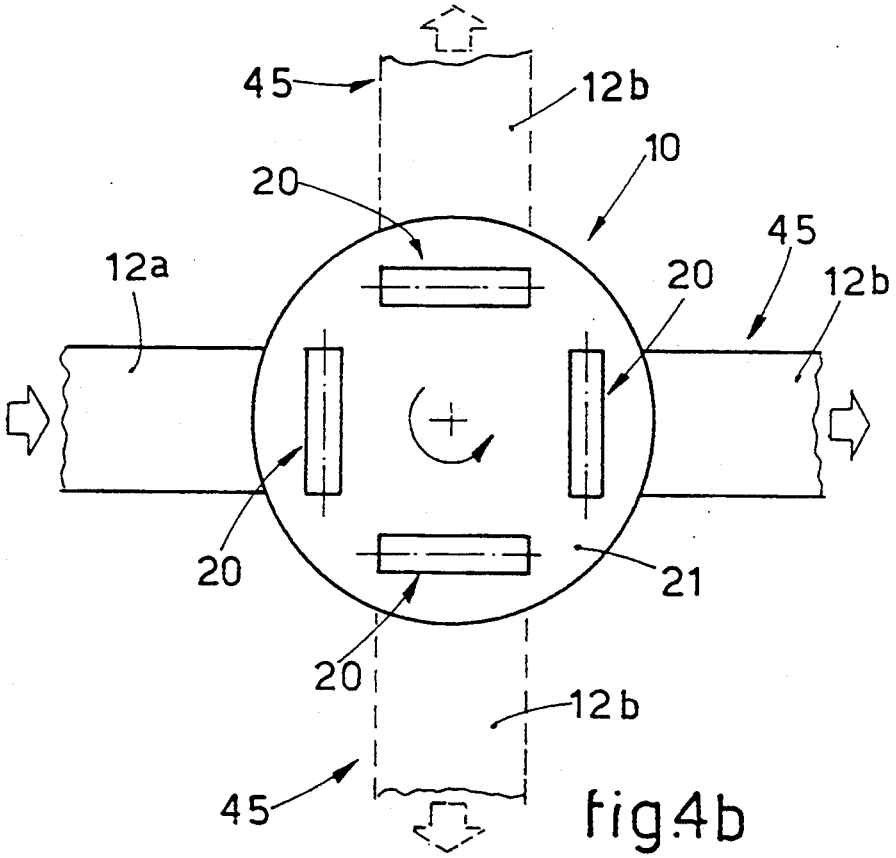

According to a variant (see FIGS. 4*a*–4*b*) the coiling-uncoiling units 20 on the rotary base plate 21 are three (FIG. 4*a*) or more in number but advantageously four (FIG. 4*b*).

When there are three coiling-uncoiling units 20 (FIG. 4*a*), the rolling line 45 downstream of the winding-unwinding assembly 10 will lie at an angle of about 120°, in one direction or the other, to the line of feed of the thin slab 12 being fed.

When there are four coiling-uncoiling units 20 (FIG. 4*b*), the rolling line 45 downstream of the winding-unwinding assembly 10 will lie on the same axis as, or perpendicular to, the feed line of the thin slab 12*a* being fed.

Where there are more than two coiling-uncoiling units 20 (FIG. 4), the units 20 which are not engaged in coiling or uncoiling can be used as storage points in the event of jamming or other problems in the downstream rolling line 45.

The coiling-uncoiling units 20 used as storage points can also be employed, when they are equipped with heating means 50, as a furnace to heat and/or equalise the temperature of coils 33 already wound in rolls.

The heating means 50 have the task of keeping substantially constant the temperature of the coils 33 of the thin slabs 12.

In this example the heating means 50 consist of electrical resistors 51 located on the walls which contain and cover the winding-unwinding assembly 10 according to the invention.

According to a variant the heating means 50 consist of a series of small burners, which too are located on the walls containing and covering the winding-unwinding assembly 10 according to the invention.

Figure 3:
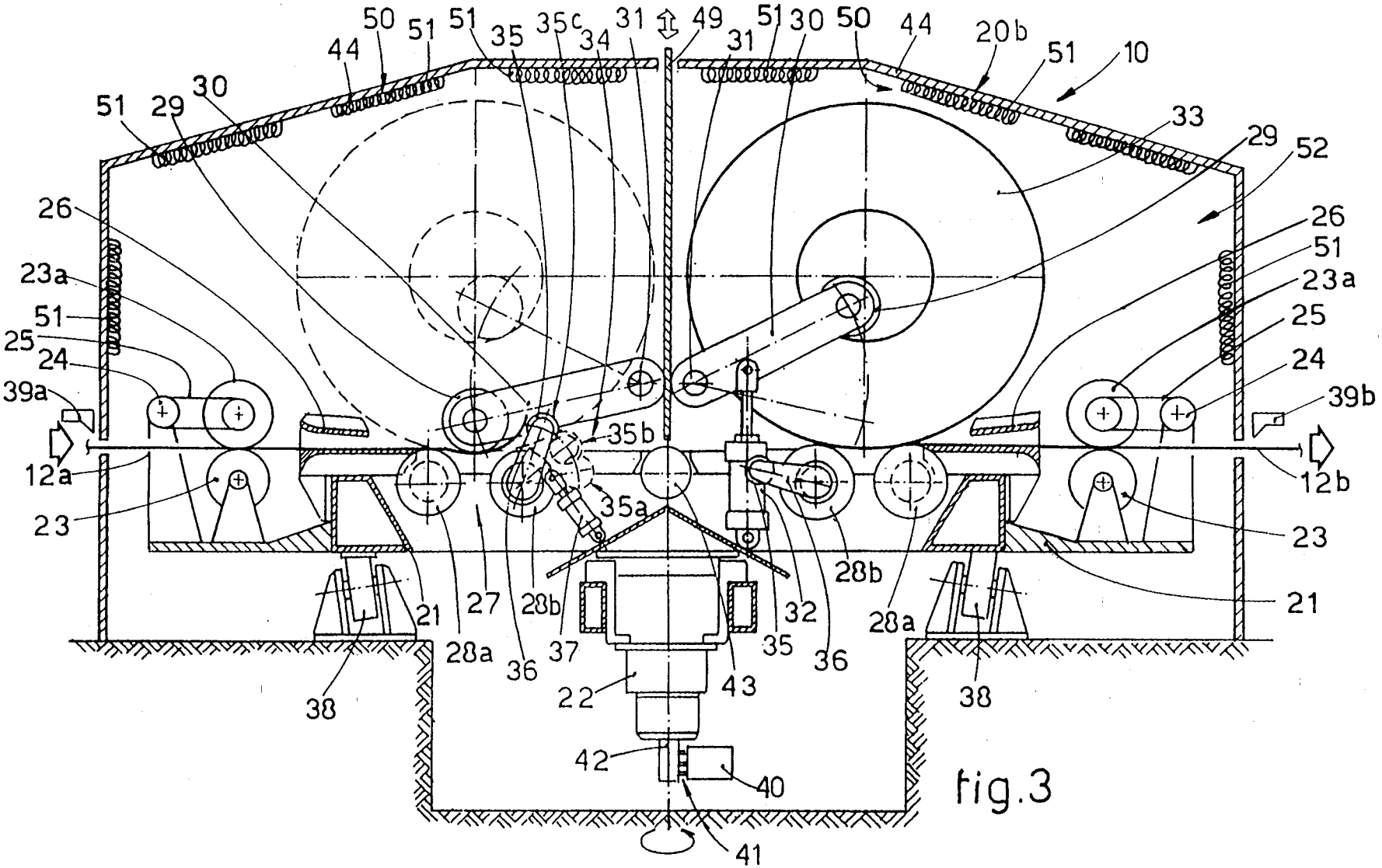
FIG. 3 shows a lengthwise section of a winding-unwinding assembly according to the invention.

In the example shown in FIG. 3 the rotary base plate 21 is supported on a plurality of idler wheels 38 having substantially horizontal stationary axes and positioned circumferentially.

The winding-unwinding assembly 10 according to the invention cooperates with two pairs of drawing rolls 23 positioned upstream and downstream respectively of the assembly 10; at least one roll 23*a* of each pair of rolls 23 is powered.

The drawing rolls 23 are arranged parallel to each other and one of each pair is superimposed on the other; these rolls 23 have their axes of rotation substantially horizontal and perpendicular to the direction of feed of the thin slab 12*a* being coiled.

In this case the powered drawing roll 23*a* of each pair is fitted to a supporting arm 25 pivoted on a pivot 24 and is associated with a coaxial motor, which is not shown here.

In this case the pairs of drawing rolls are solidly installed on the rotary platform 21.

According to a variant the pairs of drawing rolls 23 are fitted immovably to the floor.

Each coiling-uncoiling unit 20 includes a lead-in guide 26, downstream of which is positioned a curvature-imparting device 27 with which the thin slab 12*a* being coiled cooperates. This curvature-imparting device 27 includes two powered rotary rolls 28, namely a first rotary roll 28*a* and a second rotary roll 28*b* respectively, which have their axes of rotation substantially horizontal and perpendicular to the direction of feed of the thin slab 12*a* being coiled.

A curvature-imparting roll 29 positioned above the powered rotary rolls 28 in a substantially intermediate position cooperates with the two powered rotary rolls 28, which are positioned suitably spaced apart and have their upper sides lying at a tangent to the thin slab 12 being coiled.

The curvature-imparting roll 29 is supported, so as to be free to rotate, at its two ends on two first oscillatory supporting arms 30, at least one of which can be disengaged from the curvature-imparting roll 29.

The curvature-imparting roll 29 can be moved from a position of cooperation between the powered rolls 28 to an upper position when the coiled roll 33 has been completed.

These first supporting arms 30 are pivoted at their other ends on a stationary pivot 31 solidly fixed to the winding-unwinding assembly 10 according to the invention.

The first supporting arms 30 are actuated by first positioner means 32, which in this case consist of cylinder-piston actuators and cause rotation of the first supporting arms 30 about the pivot 31 and thus control the height of the curvature-imparting roll 29 while the thin slab 12 is being coiled to form a wound roll 33.

When the first positioner means 32 are actuated, the pressure exerted by the curvature-imparting roll 29 towards the powered rolls 28 is adjusted.

The winding-unwinding assembly 10 according to the invention comprises also a forming device 34 to form the first coil of the roll 33 of thin slab 12*a* being coiled.

In this example the forming device 34 consists of an idler dancer roller 35, which is parallel to the powered rolls 28 and is fitted at the end of two second supporting arms 36 pivoted on the second powered roll 28*b*.

The second supporting arms 36 are actuated by second positioner means 37, which consist in this case of a cylinder-piston actuator and take the dancer roller 35 from a position of no contact 35*a* to a first 35*b* and then a second 35*c* position of contact with the thin slab 12*a*.

For the sake of clarity FIG. 3 does not show in the first coiling-uncoiling unit 20*a* the first positioner means 32, nor does it show the second positioner means 37 in the second coiling-uncoiling unit 20*b*.

To be more exact, the leading end of the thin slab 12*a* leaving the curvature-imparting device 27 at the beginning of the coiling step cooperates with the dancer roller 35, which is in the second position of contact 35*c* and imparts to the thin slab 12*a* a first small radius of curvature to form the first coil of the roll 33 being coiled.

While the thin slab 12*a* continues being fed and coiled, the second positioner means 37 lower the second supporting arms 36 of the first coiling-uncoiling unit 20*a* performing the coiling, thus bringing the dancer roller 35 to its first contact position 35*b* progressively.

At the same time the first supporting arms 30 are raised progressively by the first positioner means 32 according to the ever greater dimensions of the roll of thin slab 12*a* being coiled.

During uncoiling of the wound roll 33 the second positioner means 37 bring the idler dancer roller 35 to the position of no contact 35*a* with the thin slab 12*a*.

Each of the coiling-uncoiling units 20 comprises at its sides and at its top a removable hood 44 which is advantageously insulated. In this example the hood 44 defines an insulated chamber 52, which encloses the lead-in guides 26 and the pairs of drawing rolls 23 of the respective coiling-uncoiling units 20.

According to a variant the pairs of drawing rolls 23 are installed outside the insulated chamber 52.

In this case the two coiling-uncoiling units 20 are divided by a movable inner partition 49, which too is advantageously insulated and can be moved vertically and be fitted or removed as required.

In particular, the movable inner partition 49 is fitted when, for maintenance purposes or in the event of a breakdown, one of the two coiling-uncoiling units 20*a*–20*b* has to be shut down and uncovered while the other coiling-uncoiling unit 20*b*–20*a* continues working.

The winding-unwinding assembly 10 according to the invention is equipped with a second sensor 39*a* and a third sensor 39*b* fitted respectively upstream and downstream of the rotary platform 21: the sensors 39*a*–39*b* detect the tail end of the thin slab 12 being coiled 12*a* and uncoiled 12*b* respectively.

The first sensor 39*c*, as soon as it detects the arrival of the tail end of the preceding thin slab 12, transmits a signal which causes acceleration of the drawing rolls 23 performing the winding up and of the relative coiling-uncoiling unit 20*a* performing the coiling.

This acceleration of the speed of drawing the thin slab 12 leads to the formation of a gap between the tail end of the preceding thin slab 12 and the leading end of the next thin slab 12 so that, when the second sensor 39*a* detects the arrival of the tail end of the preceding thin slab 12*a* being coiled and when the third sensor 39*b* detects the absence of the thin slab 12b being uncoiled from the second coiling-uncoiling unit 20b, the motor 22 rotates by 180° the winding-unwinding assembly 10 according to the invention.

The second coiling-uncoiling unit 20b is now facing towards the direction of arrival of the thin slab 12a, whereas the first coiling-uncoiling unit 20a bearing the coiled roll 33 of thin slab 12 just packaged is ready for the uncoiling step.

In this case a drive unit 40 of the winding-unwinding assembly 10 according to the invention is of an electrical type and its connections are provided with brush-type wiper contacts 41 which are in contact with the outer surface of a shaft 42 of the motor 22.

By means of the drive unit 40 of an electrical type as shown in FIG. 3 the winding-unwinding assembly 10 according to the invention can rotate by 360° continuously.

According to a variant not shown in the figure, when the drive unit 40 is of a hydraulic and/or pneumatic type, the connecting conduits make possible a rotation of 180° of the rotary base plate 21, which has to be returned to its initial position with a rotation of 180° in the opposite direction.

When the rolling line 45 of the thin slab 12 downstream of the winding-unwinding assembly 10 according to the invention travels at the same speed as the continuous casting plant 11 feeding the winding-unwinding assembly 10, and when the rolling line 45 is of a continuously working type, the thin slab 12 can pass through the winding-unwinding assembly 10 without coming into contact with the curvature-imparting device 27 or the forming device 34 (see FIGS. 2c–3).

In this case (see FIGS. 2c–3) the thin slab 12 slides directly along its substantially horizontal sliding plane and cooperates with the pairs of drawing rolls 23 and with supporting means, which in this case consist of a central supporting roll 43 having its axis parallel to the axes of the drawing rolls 23 and fitted below, and at a tangent to, the sliding plane.

FIG. 2a shows a winding-unwinding assembly 10 according to the invention, which is installed upstream of a rolling line 45, in which the thin slab 12 being uncoiled and leaving the winding-unwinding assembly 10 cooperates with a pair of winding-unwinding rolls 46a–46b of a known type, between which is positioned a reversible rolling mill stand 115. In this case the thin slab 12b is caused to cooperate repeatedly in both directions with the reversible rolling mill stand 115 and is wound up and unwound on the winding-unwinding rolls 46a–46b until it has been brought to the desired thickness.

Thereafter the thin slab 12 is fed into a heating and temperature-equalisation furnace 47 and is then coiled to form a wound roll 48.

If the rolling line 45 is of the type of FIG. 2b, two reversible rolling mill stands 115 are included and in this way a shorter rolling time is achieved than with the plant of FIG. 2a.

In the plant shown in FIG. 2c the rolling line 45 consists of a plurality of one-way rolling mill stands 215; in this example the thin slab 12 is caused to move at the same speed as the continuous casting plant 11 and does not have to cooperate with the coiling-uncoiling units 20a–20b of which the winding-unwinding assembly 10 consists.

We claim:

1. Assembly to wind-unwind thin slabs which cooperates with a continuous casting plant producing thin slabs and is positioned on the same axis as that plant, a heating and temperature-equalisation furnace being included upstream of a winding-unwinding assembly, at least one pair of drawing rolls cooperating with the winding-unwinding assembly, the winding-unwinding assembly comprising at least two coiling-uncoiling units positioned circumferentially equidistant from, and on, a base plate able to rotate about a substantially central vertical axis, one of the units taking over alternately the position and function of another unit and vice-versa, each coiling-uncoiling unit being equipped with its own lead-in guide and powered rolls, the powered rolls being coplanar and positioned below a thin slab being processed and cooperating with a curvature-imparting roll, which can be moved from a position of cooperation with, and between the powered rolls to an upper position when a coiled roll has been fully coiled, the curvature-imparting roll cooperating with actuator means that adjusts its pressure towards the powered rolls, the actuator means being associated with arm means that support the curvature-imparting roll, the lead-in guide lying on the same plane as the plane of feed of the thin slab and as the upper side of the powered rolls.

2. Assembly as in claim 1, in which a dancer roller is included downstream of the second powered roll and can be moved substantially vertically by an actuator and can take up one position of non-contact and at least one position of second contact with the thin slab.

3. Assembly as in claim 1, in which there are included between the respective pairs of powered rolls coplanar supporting roll means and said base plate includes at least one pair of said coiling-uncoiling units positioned diametrically opposite to each other.

4. Assembly as in claim 1, in which the drawing rolls are positioned on the rotary base plate.

5. Assembly as in claim 1, in which the drawing rolls are fitted immovably to the floor.

6. Assembly as in claim 1, in which the rotary base plate is equipped with a movable insulated hood extending also laterally to define an insulated chamber.

7. Assembly as in claim 6, in which the lead-in guides and the drawing rolls are contained in the insulated chamber.

8. Assembly as in claim 6, in which determined portions of the insulated hood protecting each coiling-uncoiling unit can be removed.

9. Assembly as in claim 6, in which the insulated hood includes at least momentarily an inner insulated partition.

10. Assembly as in claim 6, in which the insulated hood cooperates with heating means.

11. Assembly as in claim 1, wherein the winding-unwinding assembly further comprises an insulated hood defining a chamber within which the at least two coiling-uncoiling units are provided, the insulated hood comprising a plurality of individual, removable segments, each of said segments covering to each of the at least two coiling-uncoiling units.

12. Assembly as in claim 11, wherein the winding-unwinding assembly further comprises a removable inner partition separating one of the at least two coiling-uncoiling units from another of the at least two coiling-uncoiling units.

13. Assembly as in claim 11, wherein the at least one pair of drawing rolls is provided within the insulated hood.

14. Plant for the continuous casting of thin slabs which comprises in sequence at least one continuous casting machine, a heating and temperature-equalisation furnace (17) and a winding-unwinding assembly, the plant being characterised in that it includes also an at least insulated roller conveyor between the heating and temperature-equalisation furnace and the winding-unwinding assembly.

15. Plant as in claim 14, in which drawing rolls of the coiling-uncoiling unit performing the coiling and also that coiling-uncoiling unit work with at least one first coiling speed and a second speed for coiling the final segment of the thin slab, this second coiling speed being higher than the first coiling speed.

16. Plant for the continuous casting of thin slabs which comprises in sequence at least one continuous casting machine, a heating and temperature-equalisation furnace, an insulated roller conveyor and a winding-unwinding assembly, the winding-unwinding assembly comprising:

at least two coiling-uncoiling units positioned circumferentially equidistant from, and on, a base plate able to rotate about a substantially central vertical axis, one of the units taking over alternately the position and function of another unit and viceversa, each coiling-uncoiling unit being equipped with its own lead-in guide and powered rolls, the powered rolls being coplanar and positioned below a thin slab being processed and cooperating with a curvature-imparting roll, which can be moved from a position of cooperation with, and between the powered rolls to an upper position when a coiled roll has been fully coiled, the curvature-imparting roll cooperating with actuator means that adjusts its pressure towards the powered rolls, the actuator means being associated with arm means that support the curvature-imparting roll, the lead-in guide lying on the same plane as the plane of feed of the thin slab and as the upper side of the powered rolls.

17. Plant as in claim 16, wherein the winding-unwinding assembly further comprises an insulated hood defining a chamber within which the at least two coiling-uncoiling units are provided, the insulated hood comprising a plurality of individual, removable segments, each of said segments covering to each of the at least two coiling-uncoiling units.

18. Plant as in claim 17, wherein the winding-unwinding assembly further comprises a removable inner partition separating one of the at least two coiling-uncoiling units from another of the at least two coiling-uncoiling units.

19. Plant as in claim 17, further comprising a pair of drawing rolls cooperating with each of the at least two coiling-uncoiling units for drawing the thin slab, the pair of drawing rolls being provided within the insulated hood.

* * * * *